US006467224B1

(12) United States Patent
Bertolini

(10) Patent No.: US 6,467,224 B1
(45) Date of Patent: Oct. 22, 2002

(54) DECKING TILE

(75) Inventor: Geoffrey Michael Bertolini, Duncraig (AU)

(73) Assignee: Ezydeck PTY LTD, Western Australia (AU)

( * ) Notice: Subject to any disclaimer, the term of this patent is extended or adjusted under 35 U.S.C. 154(b) by 0 days.

(21) Appl. No.: 09/616,612

(22) Filed: Jul. 14, 2000

Related U.S. Application Data

(63) Continuation of application No. PCT/AU99/00027, filed on Jan. 15, 1999.

(30) Foreign Application Priority Data

Jan. 16, 1998 (AU) ..... 1377

(51) Int. Cl.[7] ..... E04F 15/02

(52) U.S. Cl. ..... 52/177; 52/384; 52/387; 52/388; 52/581; 52/100; 52/747.11; 404/35; 404/41

(58) Field of Search ..... 52/384, 385, 386, 52/387, 388, 376, 177, 581, 747.11, 391, 98, 100; 404/35, 36, 41, 43, 44, 45, 46

(56) References Cited

U.S. PATENT DOCUMENTS

| | | | | | |
|---|---|---|---|---|---|
| 4,266,718 | A | * | 5/1981 | Sivon | 404/44 X |
| 4,744,194 | A | | 5/1988 | Yasuyoshi | |
| 4,749,302 | A | | 6/1988 | Declute | |
| 4,963,054 | A | * | 10/1990 | Hayashi | 404/34 |
| 5,006,011 | A | * | 4/1991 | Hiyahi | 404/37 |
| 5,014,488 | A | * | 5/1991 | Evangelos et al. | 52/384 X |
| 5,263,289 | A | | 11/1993 | Boyd | |
| 5,323,575 | A | * | 6/1994 | Yeh | 52/177 |
| 5,418,036 | A | | 5/1995 | Tokikawa et al. | |
| 5,806,270 | A | * | 9/1998 | Solano et al. | 52/747.11 |
| 6,119,423 | A | * | 9/2000 | Costantino | 52/98 X |

FOREIGN PATENT DOCUMENTS

| | | | | |
|---|---|---|---|---|
| EP | 206559 A2 | | 12/1986 | |
| EP | 328639 A1 | | 8/1989 | |
| EP | 679764 A2 | | 11/1995 | |
| JP | 1-214603 | * | 8/1989 | 404/35 |
| JP | 1-275802 | * | 11/1989 | 404/41 |
| JP | 3-244756 | * | 10/1991 | 52/384 |
| WO | WO 93/07339 A | | 4/1993 | |

* cited by examiner

*Primary Examiner*—Carl D. Friedman
*Assistant Examiner*—Brian E. Glessner
(74) *Attorney, Agent, or Firm*—Hogan & Hartson LLP

(57) ABSTRACT

A decking tile is disclosed which is arranged to receive a plurality of slats in a side-by-side manner. The decking tile has a plurality of apertures for receiving fasteners to retain the slats to the decking tile and connector provided around the periphery of the decking tile for connecting the decking tile to another decking tile. The decking tile is divided into a plurality of portions arranged in an array, the portions being connected to adjacent portions by a plurality of membranes. Each portion is removable from the tile upon severing of the membranes surrounding it. Two apertures are provided in each portion through which the fasteners can engage a slat positioned on said portion parallel to any side of said tile.

8 Claims, 21 Drawing Sheets

DECKING TILE

RELATED APPLICATIONS

The present application is a continuation under 35 U.S.C §120 of co-pending PCT/ACU99/00027 filed Jan. 15, 1999, (incorporated by reference herein) through which priority under 35 U.S.C. §119 of Australia Patent Application No. PP 1377 filed Jan. 16, 1998 is claimed.

FIELD OF THE INVENTION

The present invention relates to a decking tile.

BACKGROUND ART

Existing decking tiles are typically formed of plastics material and are arranged to receive wooden slats layed in a side-by-side manner, with the slats connected thereto by screws or similar fasteners. Such decking tiles are used for a variety of purposes, including providing flooring for outdoor pavilions and balconies.

One type of decking tile currently available is divided into a 4×4 grid, with holes for fasteners provided centrally in the outer most 12 parts. Such tiles are designed to have four slats provided along rows or columns of the 4×4 grid. Consequently, the middle two slats will have only two fasteners holding the slat to the tile, at opposite ends of the tile. The principal problem with this form of tile is that if a portion of the tile is cut away to accommodate a permanent fixture where the tile is layed, some of the slats may have only one fastener to retain it to the tile, with the result that the slat tends to rotate impairing the visual appearance of the tile. A secondary problem with this form of tile is that the locking mechanism has a female part provided on two sides and a male part provided on the other two sides of the tile, such that each side of any tile can connect to only two sides of another tile. Where it is desired to form patterns with the wooden slats, the arrangement of the holes for the fasteners and the requirement that each tile can be connected to only one of two sides of any other tile places restrictions on the types of patterns that can be formed.

Another type of existing decking tile is divided into a 2×2 grid, with four holes forming a diamond provided centrally within each quarter of the tile. The tile is arranged to receive four slats layed in a side-by-side manner on the tile, with each quarter receiving one half of two slats. The apertures are provided such that when the slats are layed parallel to a side of the tile, only two holes in each quarter are useable, with the other two provided in the gap between adjacent slats. The provision of the holes in a diamond pattern allows the slats to be placed parallel to any side of the tile while still providing a hole for a fastener for each slat in each quarter. If one of the quarters is removed from such a tile, two slats would then have only one fastener to hold them to the tile, again presenting problems regarding the rotation of slats on the tile. Further, the arrangement and number of holes for fasteners restricts the types of patterns that can be formed with the slats.

DISCLOSURE OF THE INVENTION

In accordance with one aspect of this invention, there is provided a decking tile divided into a plurality of portions arranged in an array, said portions being connected to adjacent portions via a plurality of membranes, each portion being removable from said tile upon severing of the membranes surrounding it, each portion arranged to receive at least two fasteners to secure a slat thereto, wherein said at least two fasteners can engage a slat positioned parallel to any side of said tile.

Preferably, at least one of said portions is divided into sub-portions connected by further membranes whereby said at least one portion can be sub-divided.

Preferably, each portion is rectangular and said sub-portions are triangular to allow said at least one portion to be divided diagonally.

Preferably, said at least one portion is arranged to allow said decking tile to be sub-divided diagonally.

Preferably, each portion forms a square having a side length commensurate with that of the width of a slat.

Preferably, each portion includes at least two apertures, each aperture arranged to receive a fastener therethrough.

Preferably, each aperture includes a widened section adjacent one end thereof.

Preferably, said aperture is formed in a foot of said tile.

Preferably, said tile includes connecting means provided at each side thereof such that any two sides of adjacent tiles can be connected.

Preferably, said connecting means comprises first and second components, each side including both first and second components thereon.

Preferably, said first component comprises a pair of first arms spaced apart and inwardly directed; said second component comprises a pair of second arms spaced apart and outwardly directed, wherein said second arms and said first arms are disposable in a mutually engaged position.

Preferably, said second component includes a reinforcing member extending between said second arms.

Preferably, said connecting means includes locking means arranged to inhibit disconnection of said connecting means.

Preferably, said locking means comprises a recess provided on one of said first or second arms and a protrusion provided on the other of said first and second arms.

Preferably, said apertures are provided spaced from the periphery of the portion.

Preferably, the apertures are provided on an imaginary line that bisects the portion.

Preferably, said imaginary line forms a diagonal of said portion.

Preferably, at least one aperture is provided in each sub-portion.

In accordance with another aspect of this invention, there is provided a floor covering comprising a plurality of decking tiles according to the first aspect of the invention connected together and a plurality of slats provided on the decking tiles.

Preferably, each decking tile with a side forming a part of the periphery of the floor covering has a skirt provided on each said side extending to the floor.

Preferably, said sides of the decking tiles have the connecting means removed therefrom.

In a decking tile arranged to receive a plurality of slats in a side-by-side manner, the decking tile having a plurality of apertures for receiving fasteners to retain the slats to the decking tile and connecting means provided around the periphery of the decking tile, said improvement comprising dividing the decking tile into a plurality of portions arranged in an array, the portions being connected to adjacent portions by a plurality of membranes, each portion being removable from the tile upon severing of the membranes surrounding it, each portion having at least two apertures provided therein.

BRIEF DESCRIPTION OF THE DRAWINGS

This invention will now be described with reference to two embodiments and the accompanying drawings, in which.

BEST MODE(S) FOR CARRYING OUT THE INVENTION

Figure 1:
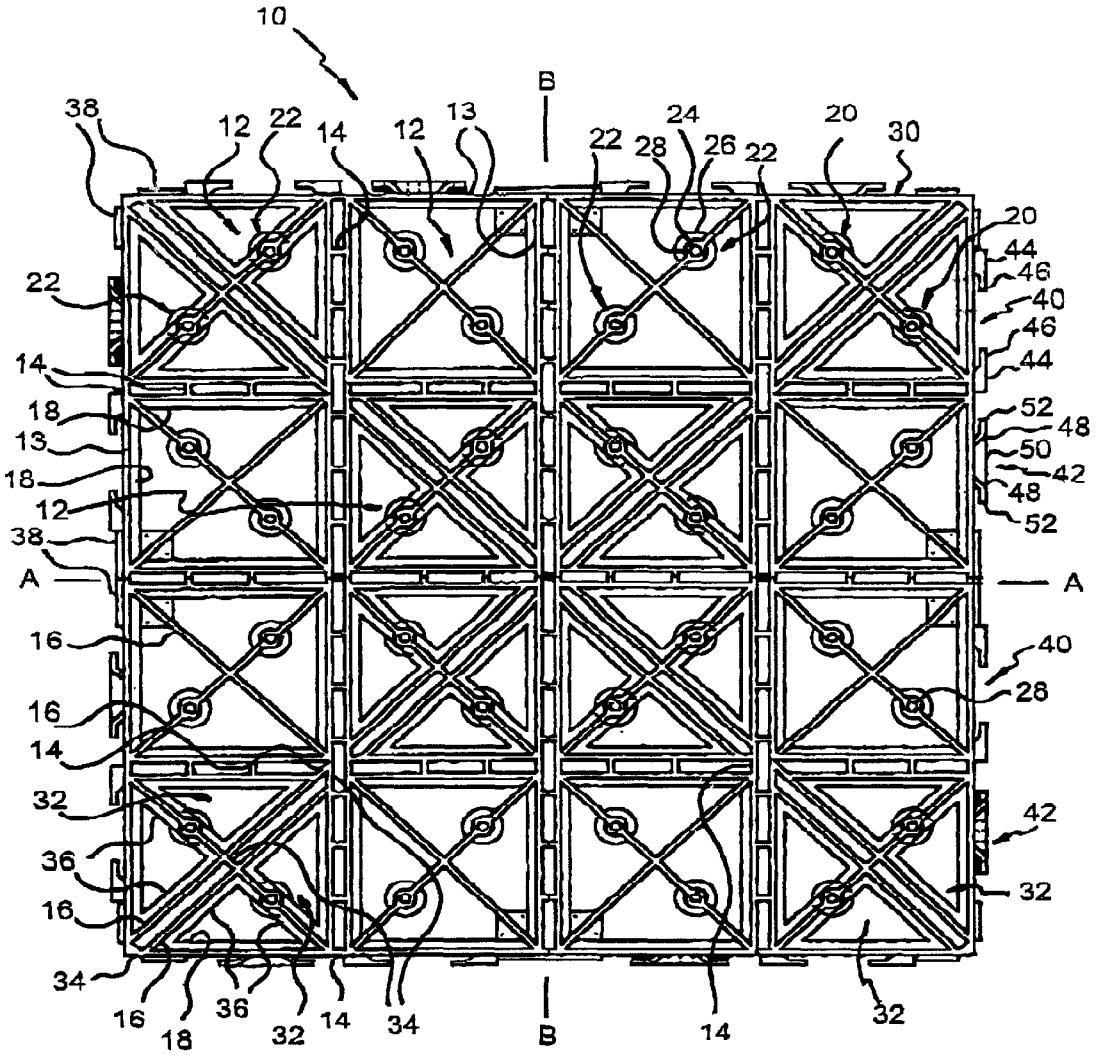
FIG. 1 is a top plan view of a decking tile according to the first embodiment of the invention.

The first embodiment is shown in FIG. 1 and is directed towards a decking tile 10 formed by a plastics injection moulding process.

The decking tile 10 comprises sixteen portions 12 arranged in a 4×4 array. Each portion 12 is defined by a wall 13 extending around its periphery and is connected to adjacent portions by a plurality of membranes 14. Accordingly, any of the portions 12 can be removed from the decking tile 10 by severing the membranes 14 surrounding it. This allows the decking tile 10 to accommodate permanent fixtures such as pipes and pillars where the decking tile is layed.

Each of the portions 12 is square in shape and includes two reinforcing members 16 extending diagonally from corner to corner, such that the reinforcing members 16 form an "X" shape.

An inwardly directed flange 18 is provided on the wall 13 of each portion 12 to increase the structural strength of the decking tile 10.

One of the reinforcing members 16 in each portion 12 has a pair of feet 20 formed integrally therewith, one to either side of the other reinforcing member 16. Each of the feet 20 comprises a cylinder 22 having a relatively narrow section 24 formed integrally with the reinforcing member 18 and a relatively wide section 26 extending beyond the reinforcing member 16 so as to protrude from a lower surface of the decking tile 10. The cylinder 22 has an aperture 28 formed axially therein. The aperture 28 has a widened section (not shown) formed in the relatively wide section 26 of the cylinder 22. The aperture 28 is arranged to receive a fastener to retain a slat to an upper surface 30 of the decking tile 10. In this regard, the widened section of the aperture 28 is intended to receive a widened portion of the fastener, such as the head of a screw. FIG. 1 is a plan view looking onto the upper surface 30 of the decking tile 10.

Eight of the portions 12 are sub-divided into two sub-portions 32 along the reinforcing member 16 of the portion 12 which does not have the feet 20 formed integrally therewith. Such portions have two reinforcing members 16 provided spaced apart adjacent the diagonal along which the portion is sub-divided. The two reinforcing members 16 are separated by further membranes 34 which can be used to sub-divide the portion 12. Such portions also include further inwardly directed flanges 36 provided on each reinforcing member 16. The sub-divided portions 12 are arranged in the decking tile 10 to allow it to be divided along a diagonal thereof.

The decking tile 10 includes a plurality of guides 38 provided at spaced locations around the periphery of the decking tile 10. The guides 38 extend upwardly of the upper surface 30 and assist to retain slats placed upon the upper surface 30 prior to fastening the slats to the decking tile 10 in that they prevent the slats from extending beyond the periphery of the decking tile 10.

The decking tile 10 further comprises connecting means provided at each side of the decking tile 10 to allow the decking tile 10 to be connected to any side of an adjacent decking tile. In the embodiment, the connecting means comprises first and second components 40 and 42, respectively, with two first components 40 and two second components 42 provided on each side of the decking tile 10 in an interlaced manner.

Each first component 40 comprises a pair of firm arms 44 provided spaced apart and having an inwardly directed portion 46. The inwardly directed portion 46 is spaced from the side of the decking tile 10.

Each second component 42 comprises a pair of second arms 48 provided spaced apart. A reinforcing member 50 extends between each pair of second arms 48. Each second arm 48 has an outwardly directed portion 52 provided spaced from the side of the decking tile 10. The outwardly directed portion 52 of each second arm 48 and the inwardly directed portion 46 of each first arm 44 are spaced an equal amount from the side of the decking tile 10 and are of substantially equal thickness. To connect two adjacent tiles together, the tiles are placed adjacent each other with one tile slightly above the other, which is then lowered to bring the first and second components on the adjacent sides of the tiles into a mutually engaged position with the first arms 44 of each first component 40 engaged with the second arms 48 of each second component 42.

The decking tile 10 is symmetrical about axes AA and BB shown in FIG. 1, allowing any side of a decking tile to be connected to any other side an adjacent decking tile.

The reinforcing member 50 in each second component 42 increases the strength of the engagement between the first and second components 40 and 42 by resistng the tendency of the second arms 48 to be forced together if two connected tiles are pulled apart.

The width of the guides 38 are half that of the first and second components 40 and 42, so that when two decking tiles are connected together, their guides 38 are touching. Further, the width of the first and second components 42 is the same as the distance between the walls 13 of adjacent portions 12, such that when decking tiles are layed in an array, the joints between tiles are not prominent.

The decking tile 10 of the first embodiment was originally intended to receive four wooden slats provided parallel to a side of the decking tile along rows or columns of the portions 12, such that each wooden slat occupied four portions 12. In this regard, it is to be noted that the arrangement of the apertures 28 in each portion 12 permits both apertures 28 in each portion 12 to be used to retain a slat thereto if necessary. This is advantageous since if some of the portions 12 are removed from the tile to accommodate a permanent fixture, the slat positioned on that row or column will also be divided an may have only one portion 12 to retain it to the decking tile 10. The ability to have two apertures in each portion 12 retain a slat prevents rotation of a slat even if that portion 12 is the only portion retaining the slat.

In addition, the incorporation of the apertures 28 into the feet 20 produces an even distribution of the feet throughout the decking tile which provides for a more even distribution of weight placed on the decking tile.

In addition to the above it has been found that having each portion able to receive at least two fasteners provides significant flexibility regarding forming patterns with the wooden slats, to be described hereinafter in relation to the second embodiment. Such patterns were in the main not possible with previous decking tiles because of the arrangement and location of fasteners on those decking tiles.

The second embodiment is shown in FIGS. 2 to 7 and is directed towards a decking tile 60. The decking file 60 is similar to the decking tile 10, with like reference numeral denoting like parts.

In the decking tile 60 of the second embodiment the further flanges 36 are provided on every reinforcing member 16, including those in portions 12 which are not sub-divided.

Further, in the decking tile 60 the feet 20 within each quarter of the tile 60 are arranged on parallel lines, with the feet 30 forming concentric diamond shapes on the entire tile. That is, each quarter of the decking tile 60 can be derived by rotating any one of the other quarters about the centre of the tile. In contrast, the feet on the decking tile 10 of the first embodiment form diamonds within each quarter.

The four inner most portions 12 of the decking tile 60 each include a further cylinder 62 arranged to receive a fastener, such that each of the four inner most portions 12 can receive three fasteners. The further cylinders 62 are provided on one of the reinforcing members 16 and are located adjacent the centre of the tile 60.

Figure 3:
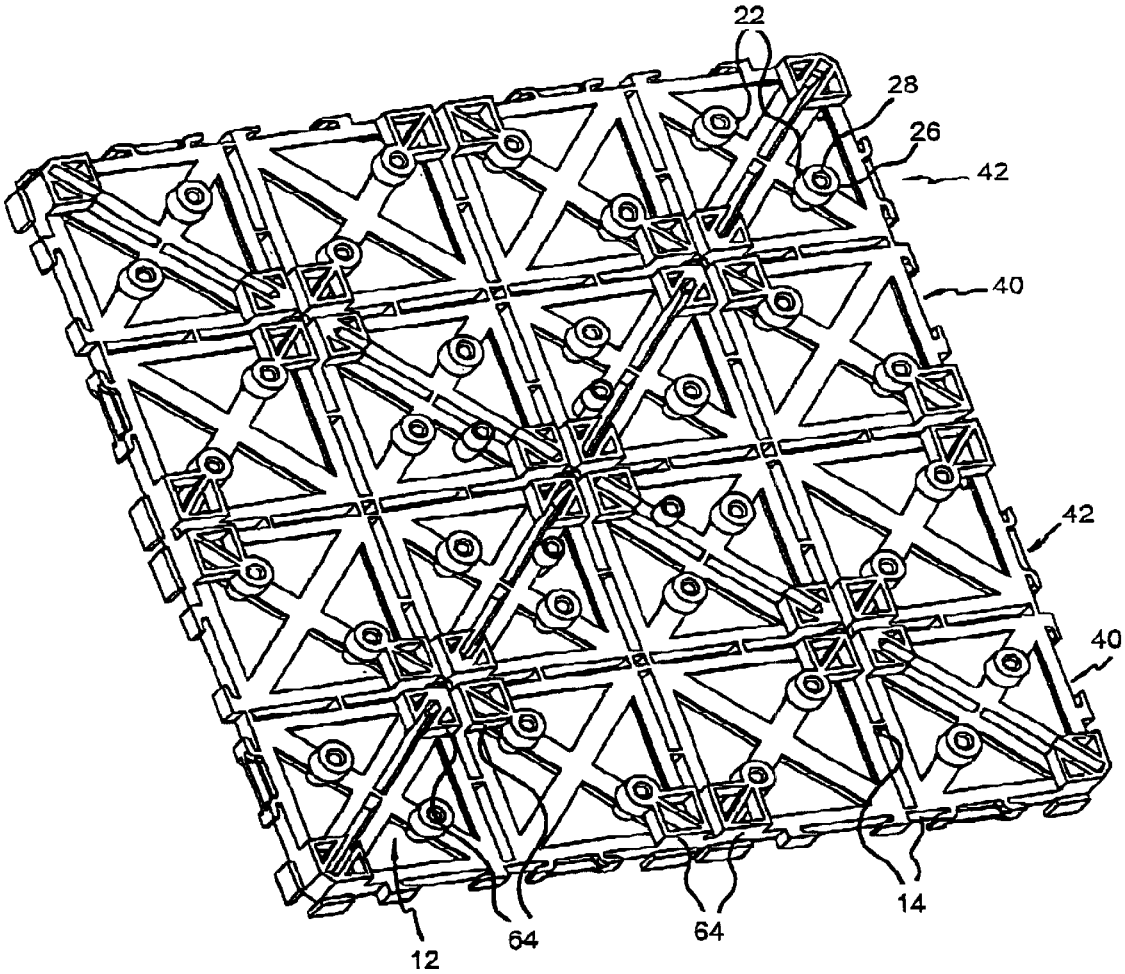
FIG. 3 is a lower perspective view of the decking tile shown in FIG. 2.

Further, the decking tile 60 further includes additional feet 64 as shown in FIG. 3. The additional feet 64 act to further distribute weight placed on the decking tile 60. Where one of the additional feet 64 is provided at a sub-division of a portion 12, the foot 64 is itself sub-divided into two halves so as to still permit removal of one of the sub-portions 32.

Figure 2:
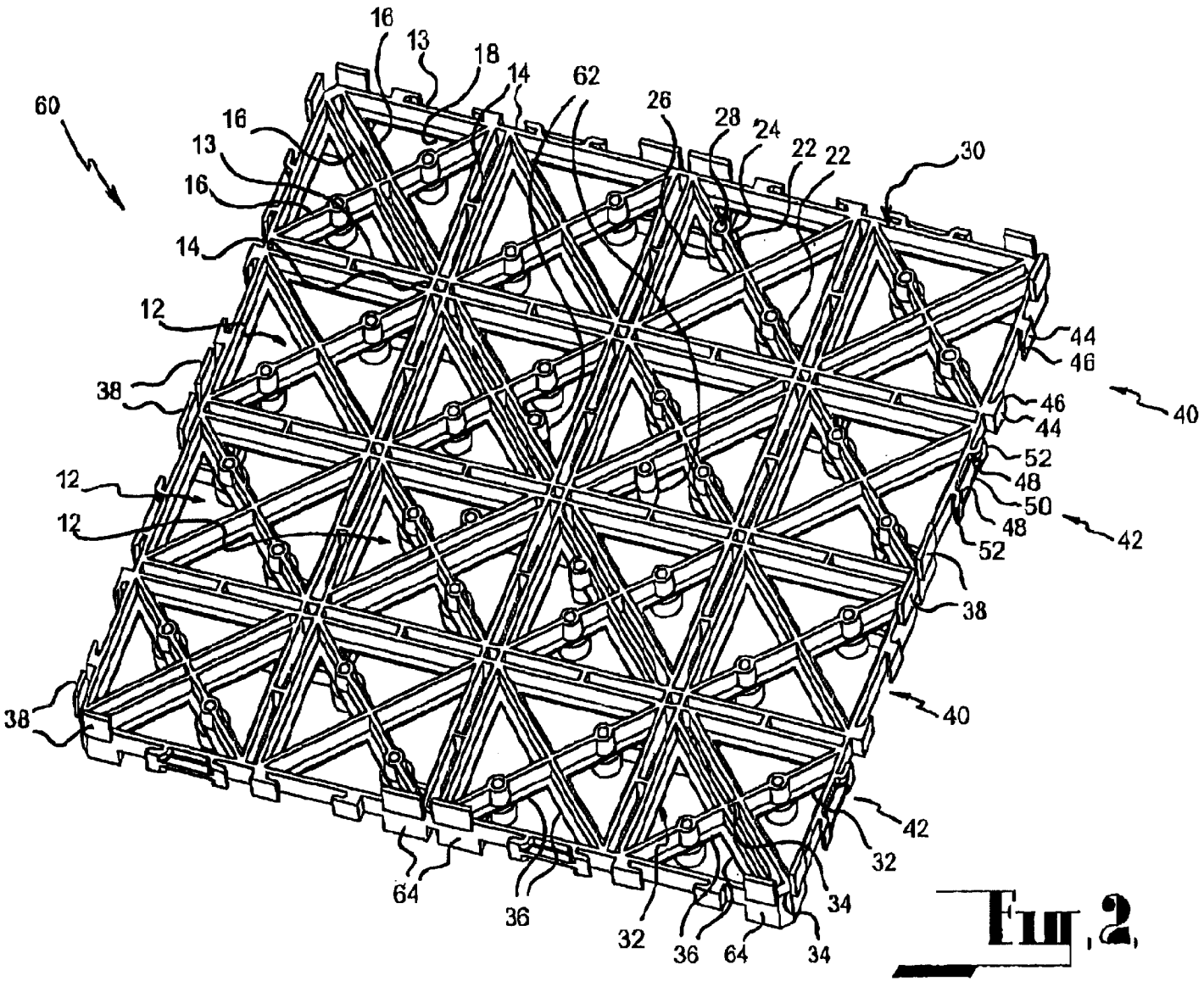
FIG. 2 is an upper perspective view of a decking tile according to the second embodiment of the invention.
Figure 7:
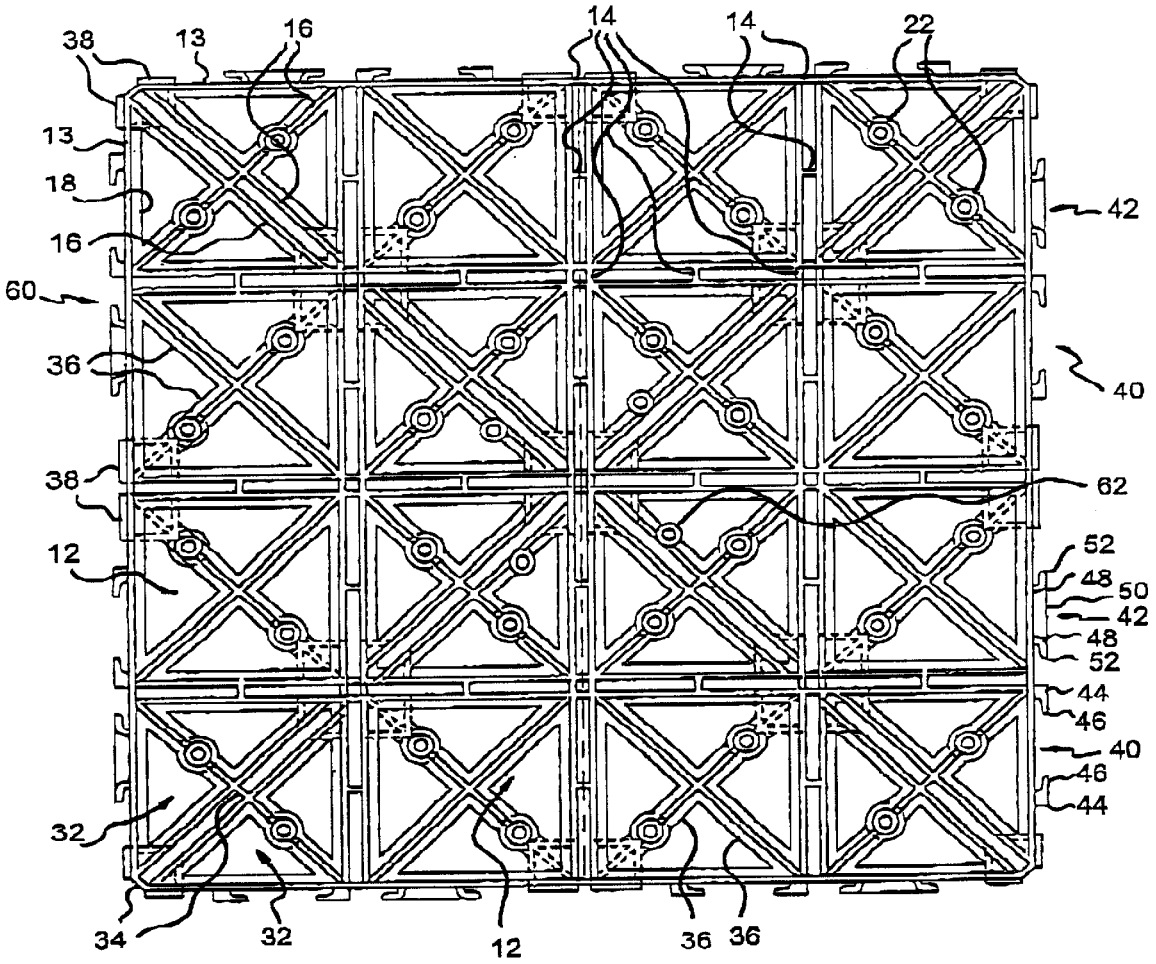
FIGS. 7A, 7B and 7C are top plan, bottom plan and side views, respectively, of the decking tile shown in FIG. 2.
Figure 7A:
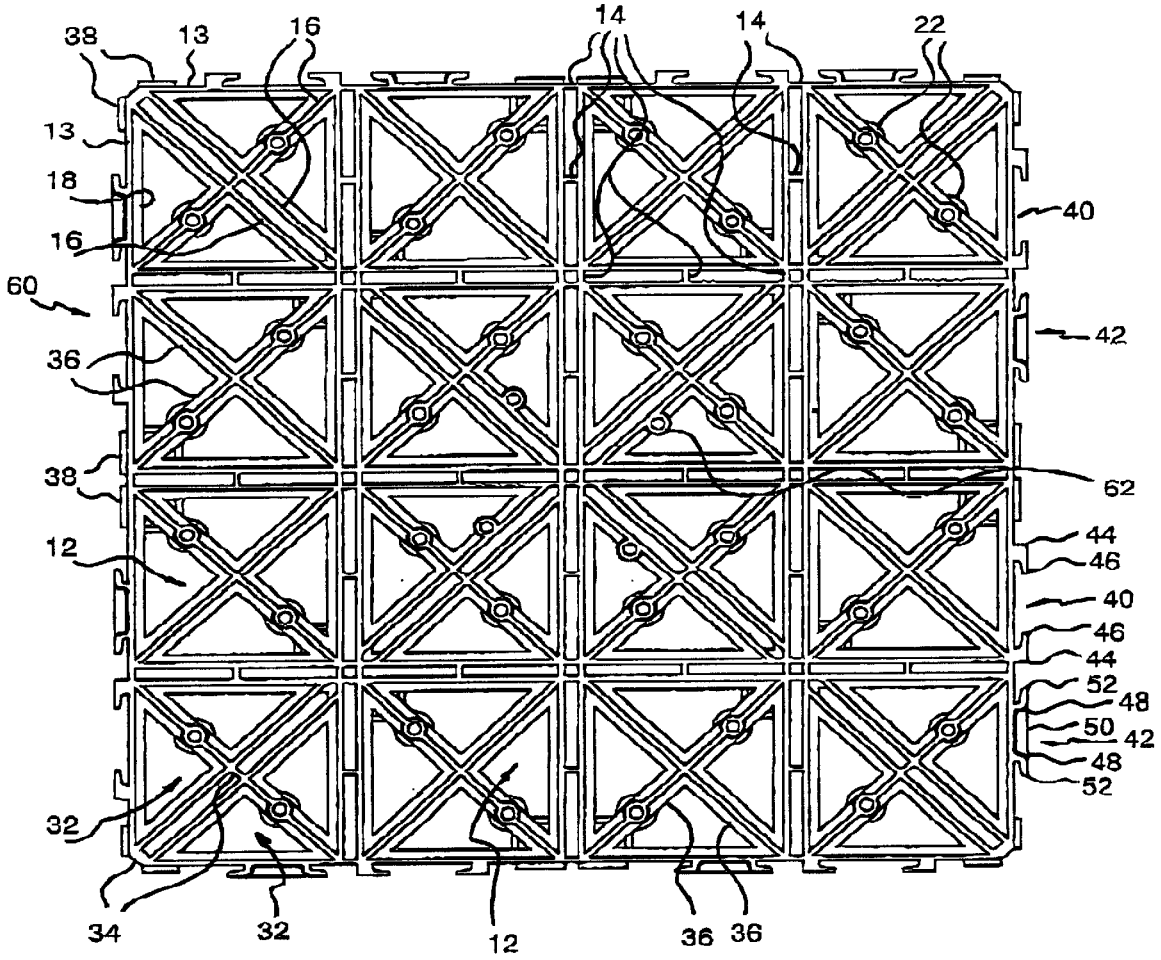
Figure 7B:
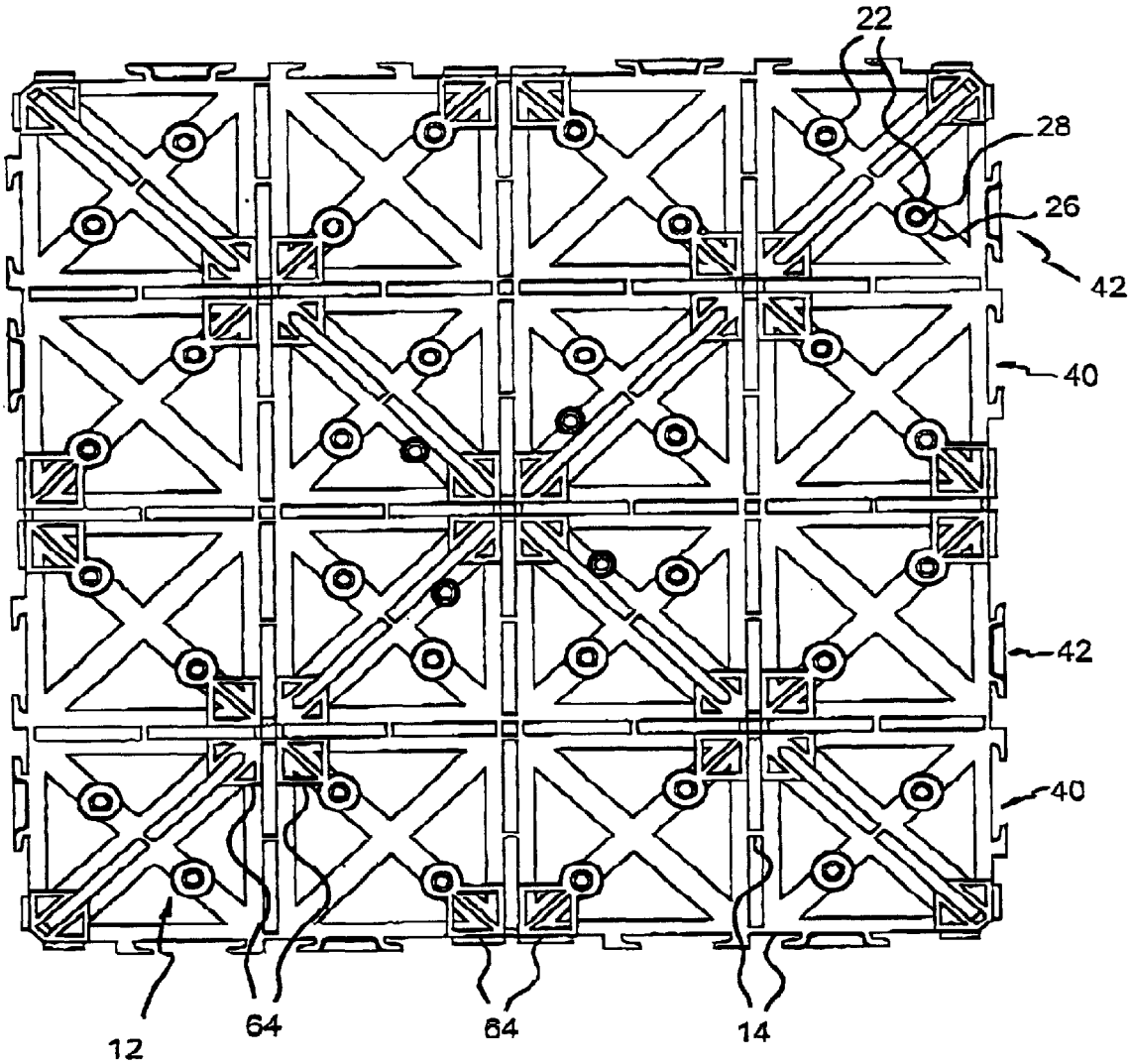
Figure 7C:
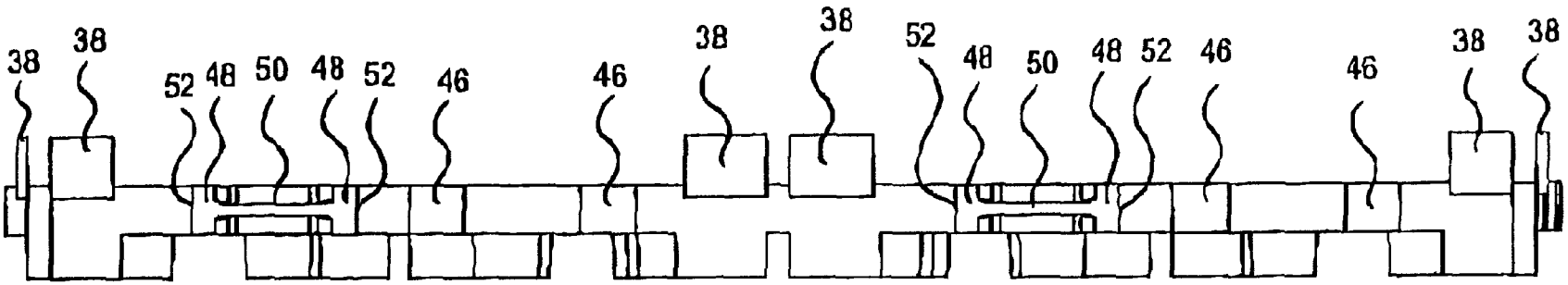

FIG. 2 is an upper perspective view of the decking tile 60 looking onto the upper surface 30. FIG. 7 is a top plan view the decking tile 60 looking onto the upper surface 30.

FIG. 3 is a lower perspective view looking toward the lower surface 64.

Figure 4:
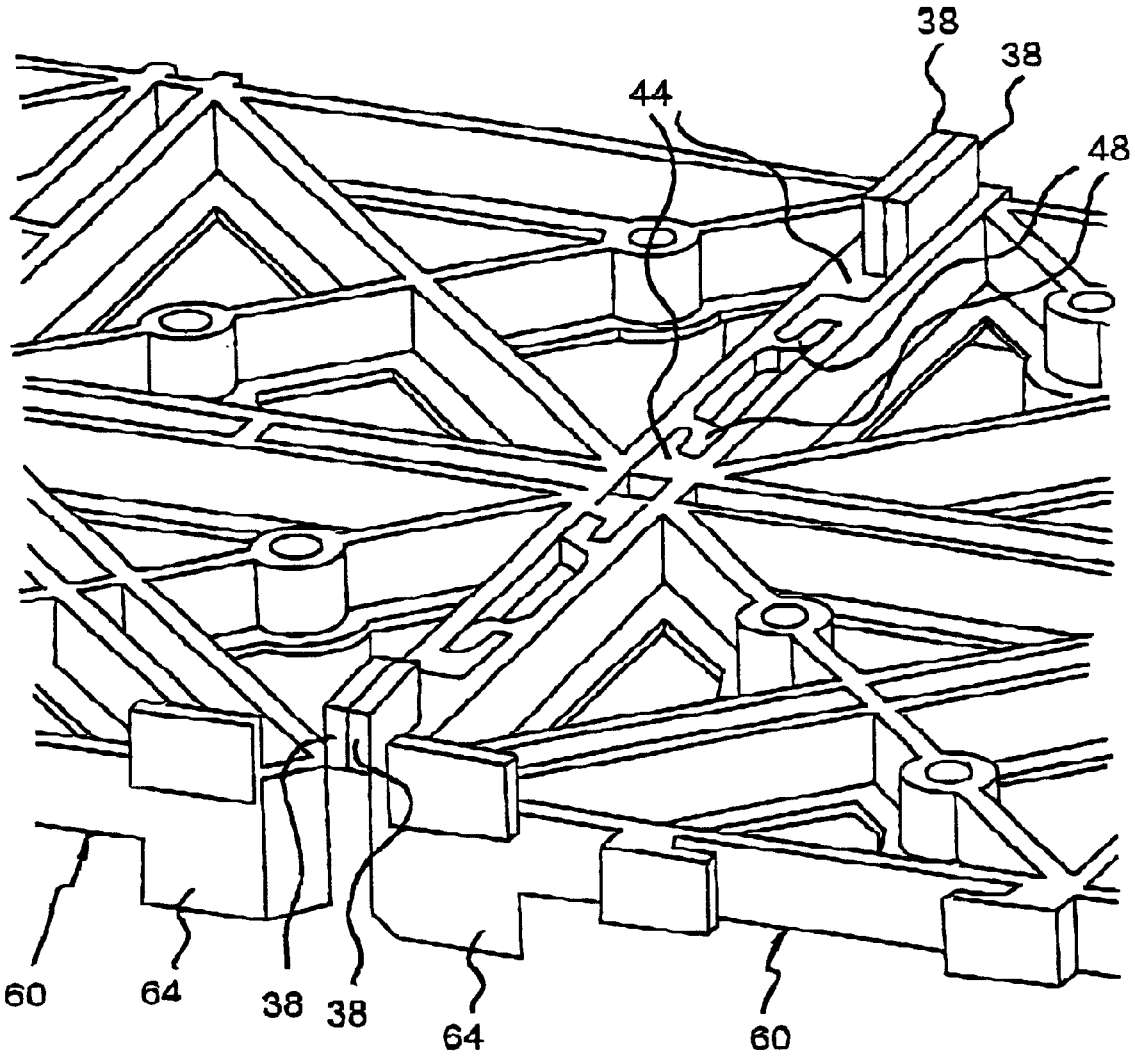
FIG. 4 is an upper perspective view of part of two adjacent tiles being connected.

FIG. 4 is an upper perspective view of part of two adjacent tiles 60 showing the first and second components connected.

Figure 5:
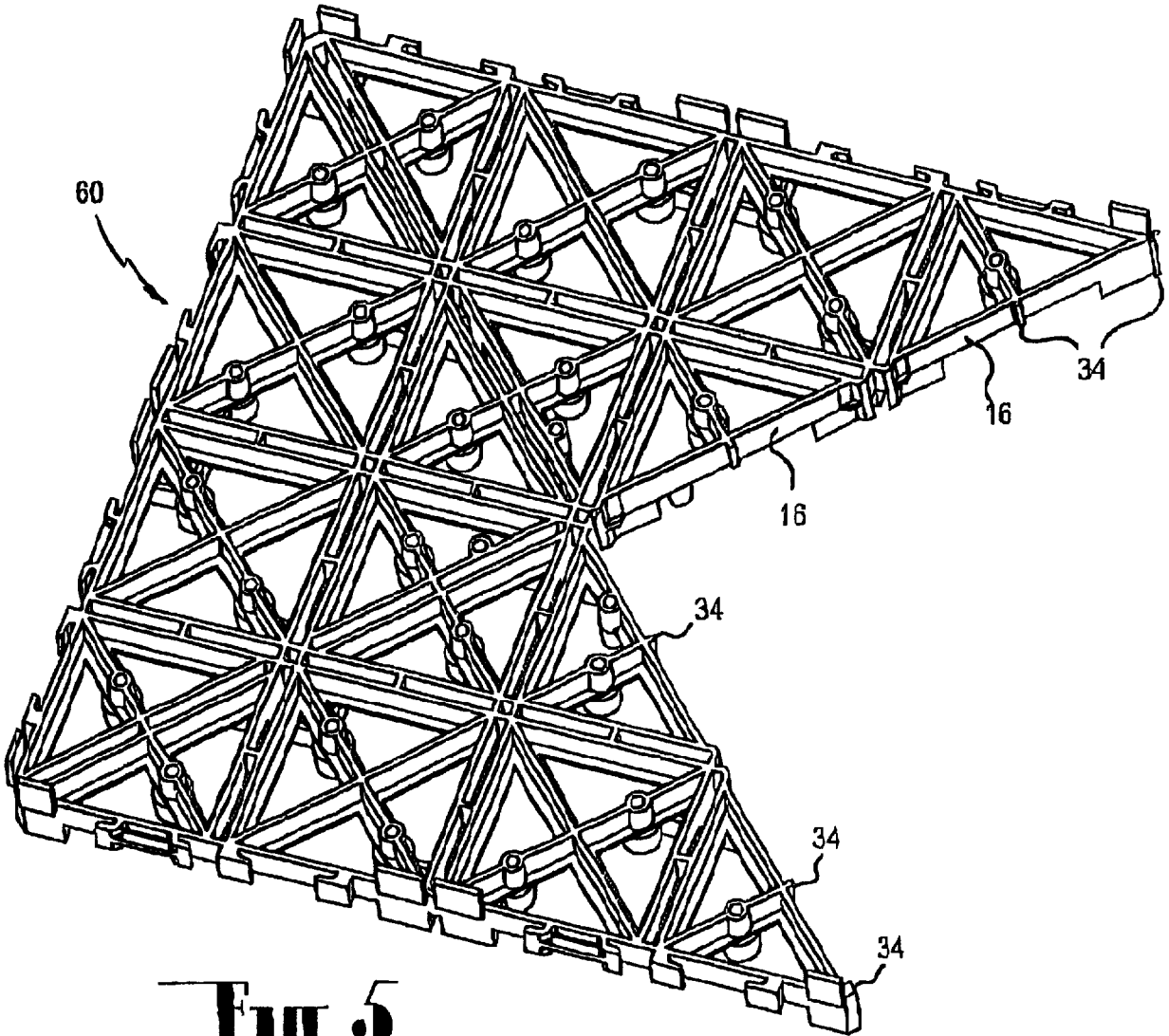
FIG. 5 is an upper perspective view of the tile shown in FIG. 2 with a quarter of the tile cut away.
Figure 6:
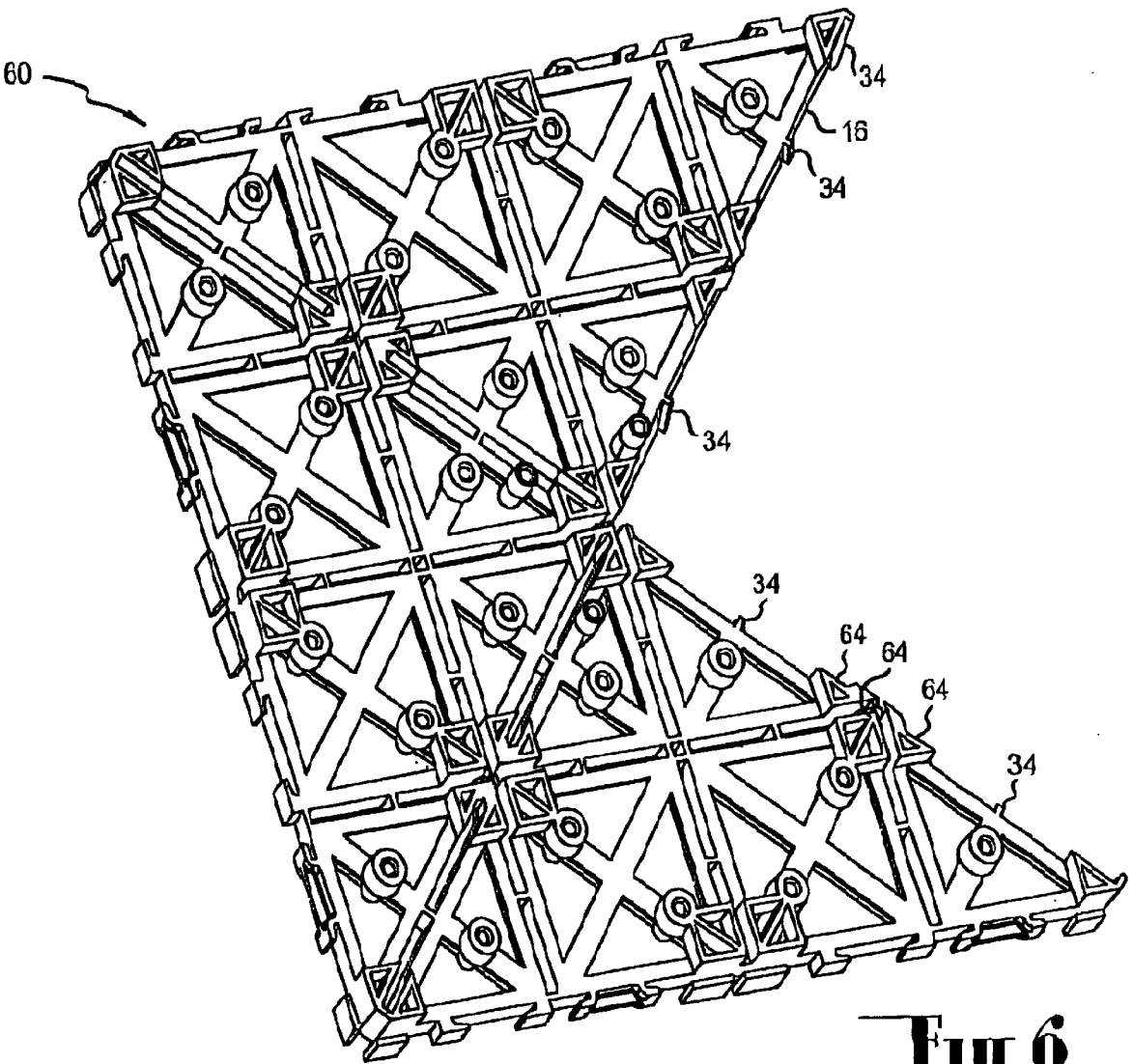
FIG. 6 is a lower perspective view of the tile shown in FIG. 5 with a quarter of the tile cut away.

As stated in relation to the first embodiment, each portion 12 or sub-portion 32 can be removed from the tile by severing the membranes 14 and/or further membranes 34. FIGS. 5 and 6 shows the decking tile 60 with a quarter of the decking tile removed by severing the further membranes 34.

FIGS. 8 to 18 shows some of the arrangements of wooden slats which are possible with the decking tiles of the invention. Each of FIGS. 6 to 12 has the apertures 28 of the decking tile 60 shown in broken lines.

Figure 8:
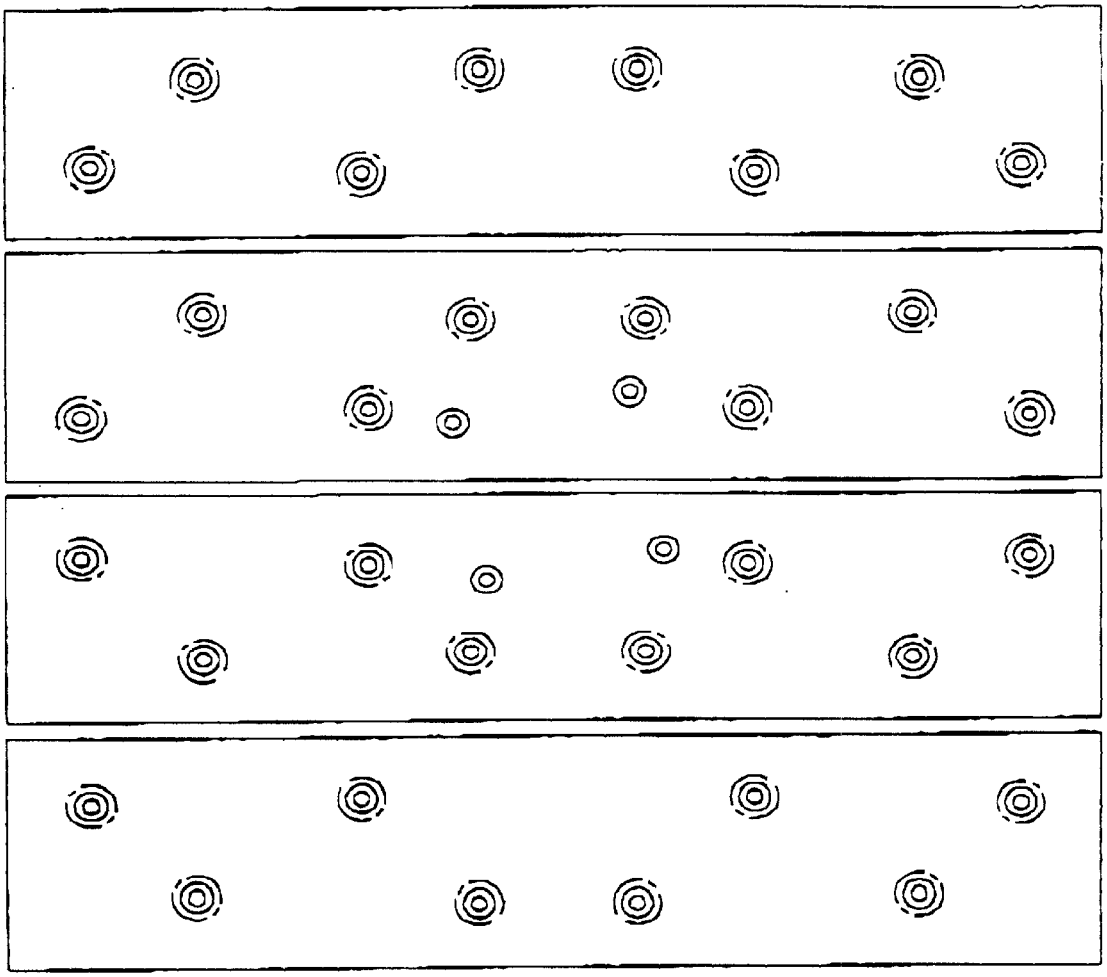
FIG. 8 shows slats in a first configuration for attaching to a decking tile, with the apertures for fasteners shown thereon.

FIG. 8 shows the typical arrangement for decking tiles, with four wooden slats layed in a parallel manner. It is envisaged that where the slats are arranged in the configuration shown in FIG. 8, only one fastener in each portion 12 of the decking tile 10 is necessary to ensure a secure fixture of each slat to the decking tile. If any of the portions 12 of the decking tile need to be removed, further fasteners can then be provided in the other apertures 28 to ensure be remaining slat is secured to the decking tile without being able to rotate.

Figure 9:
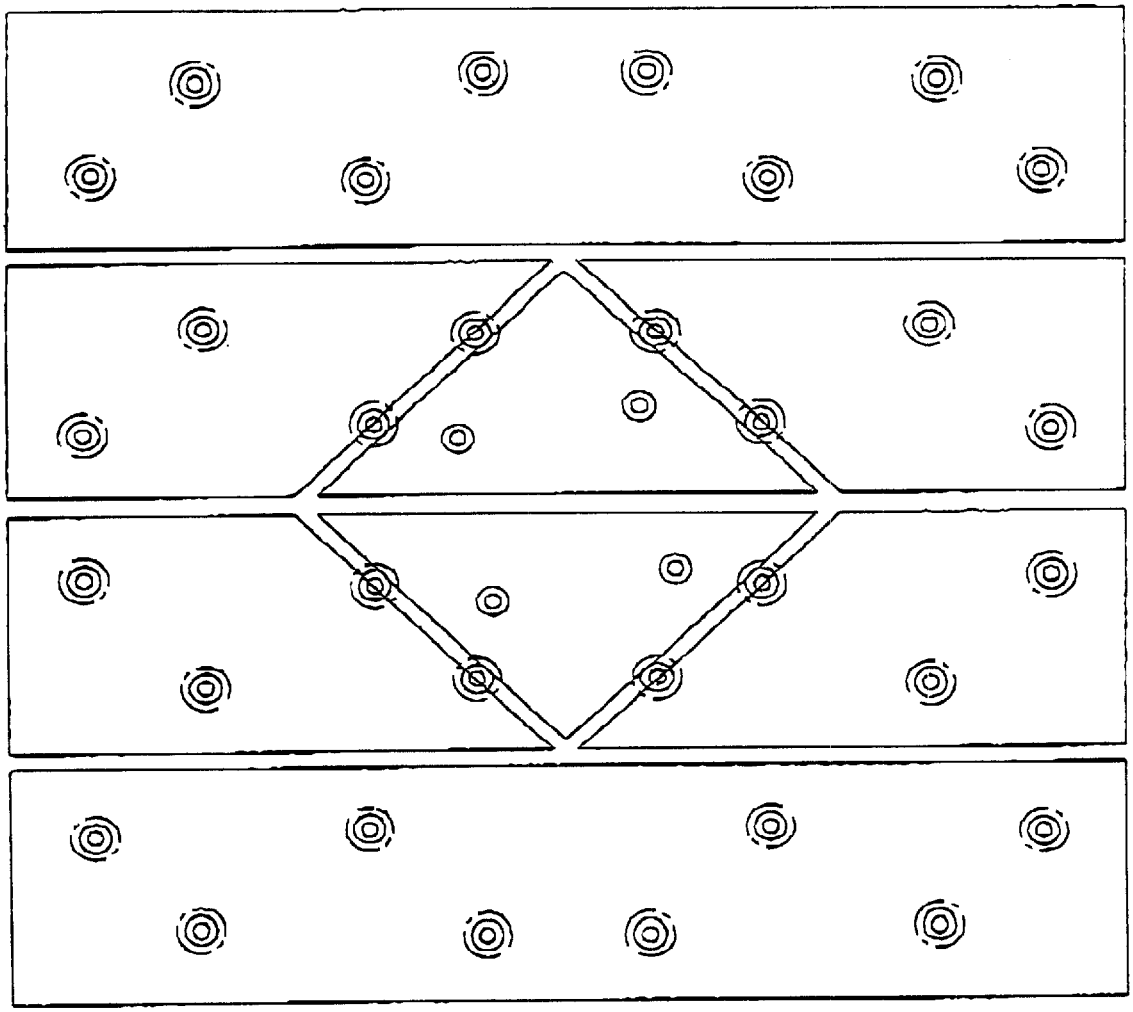
FIG. 9 shows slats in a second configuration for attaching to a decking tile, with the apertures for fasteners shown thereon.
Figure 10:
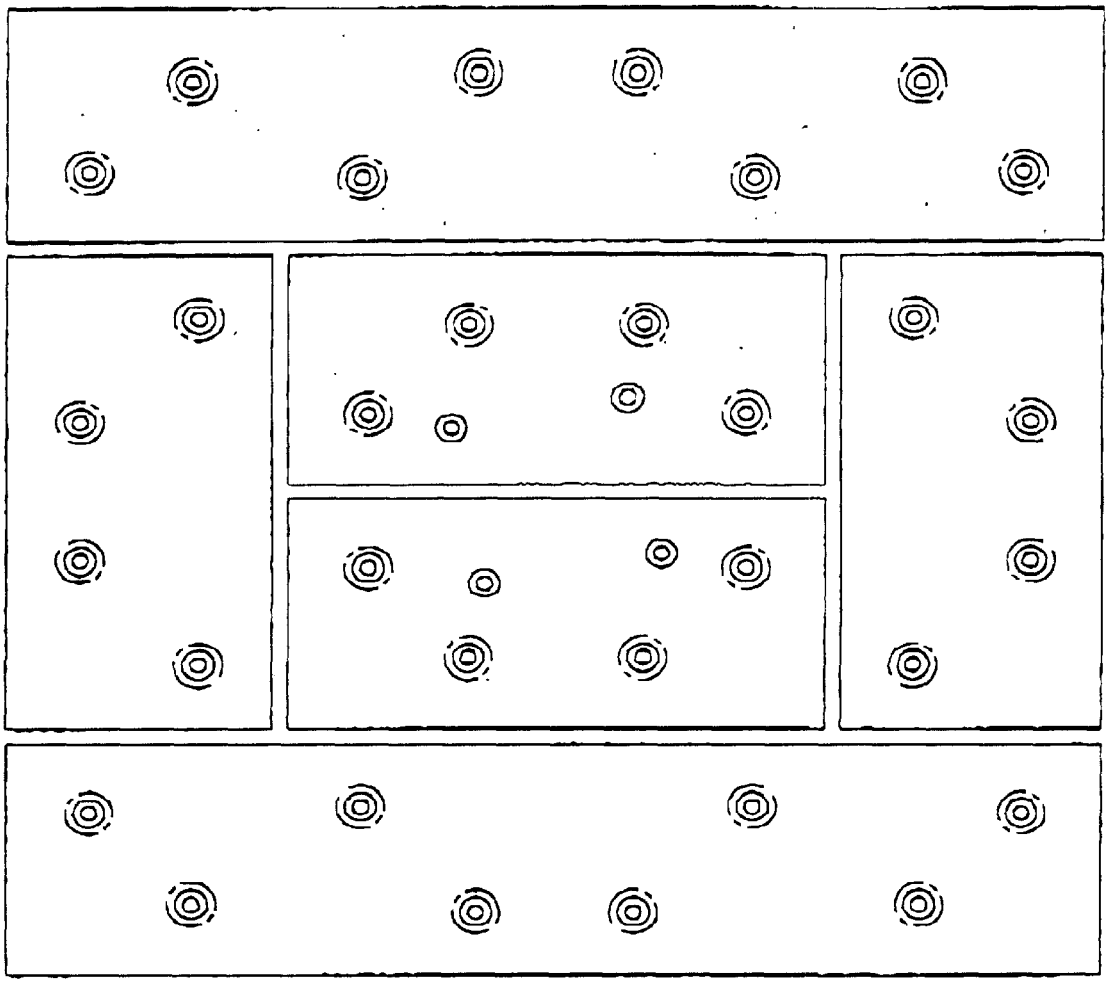
FIG. 10 shows slats in a third configuration for attaching to a decking tile, with the apertures for fasteners shown thereon.
Figure 11:
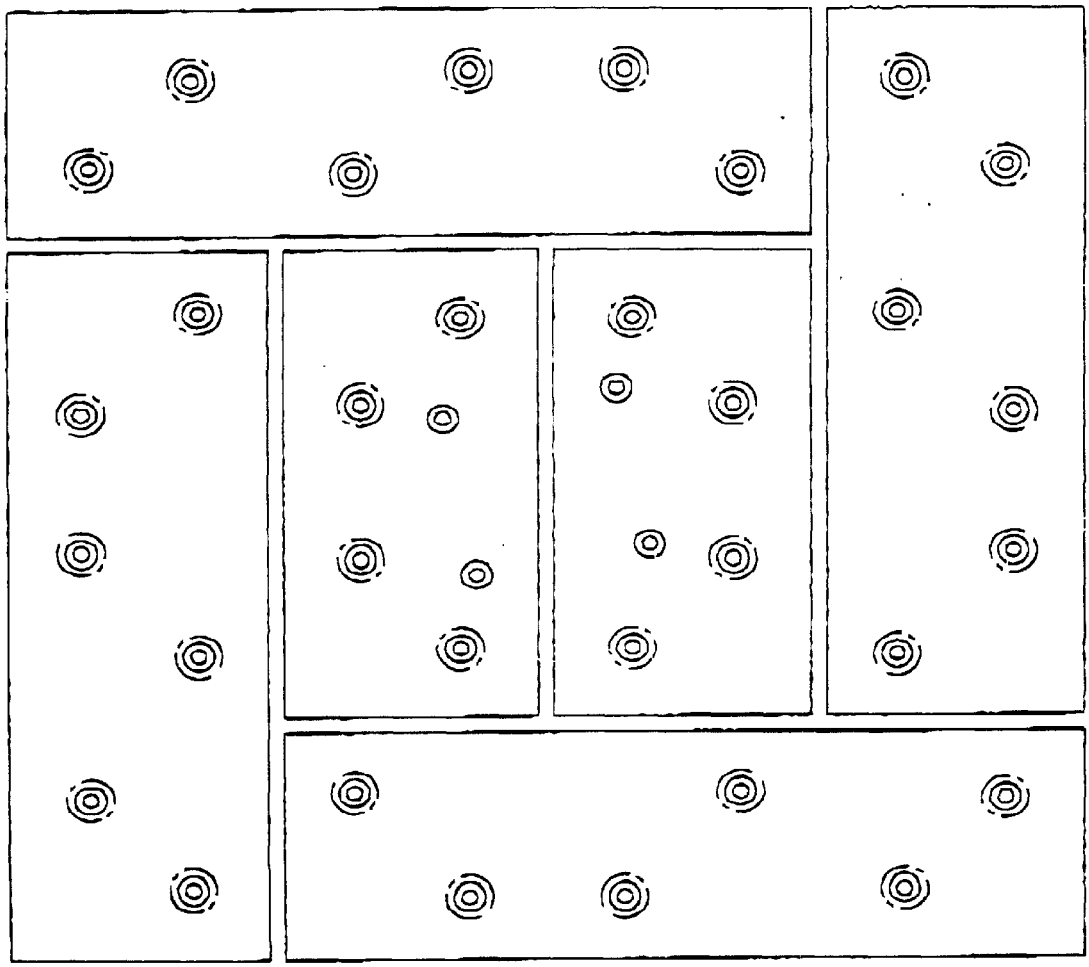
FIG. 11 shows slats in a fourth configuration for attaching to a decking tile, with the apertures for fastener shown thereon.
Figure 12:
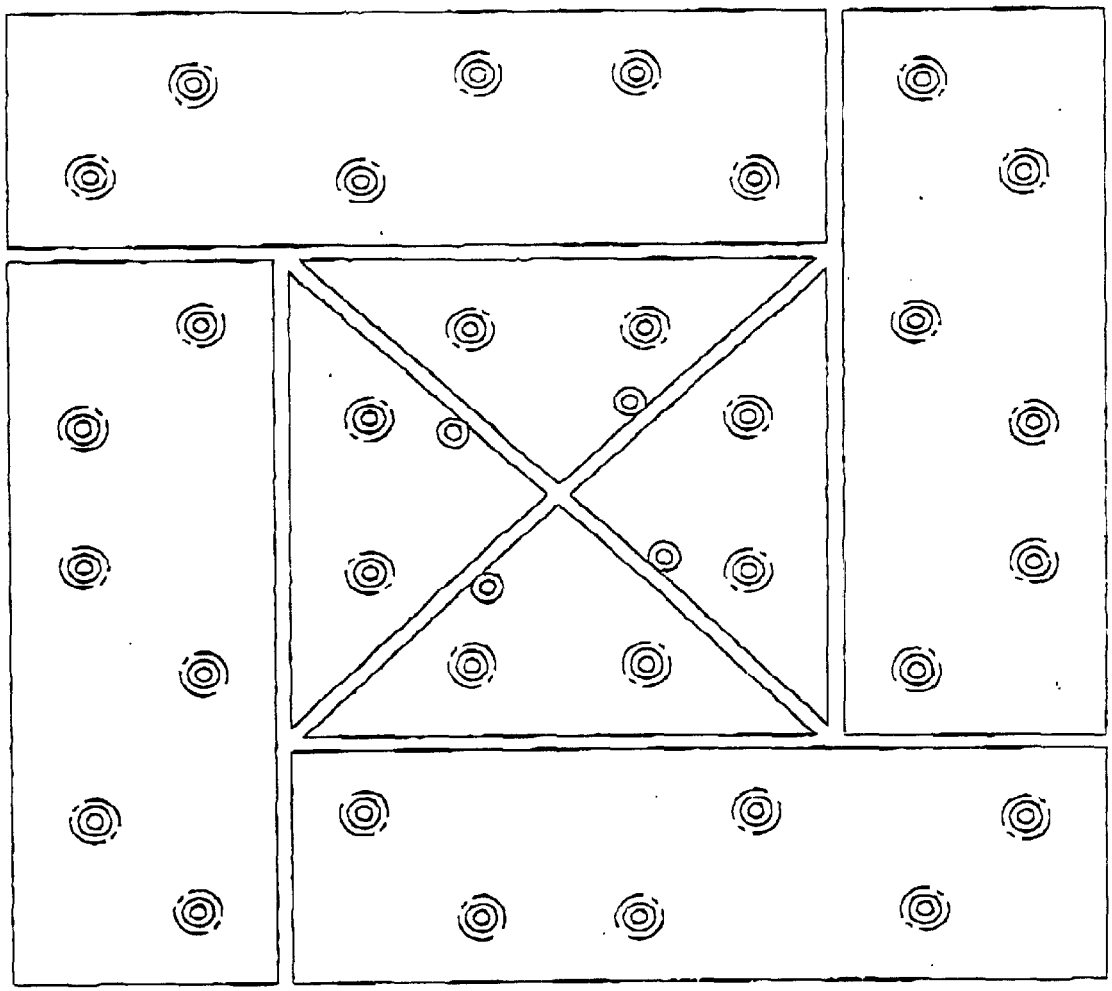
FIG. 12 shows slats in a fifth configuration for attaching to a decking tile, with the apertures for fasteners shown thereon.
Figure 13:
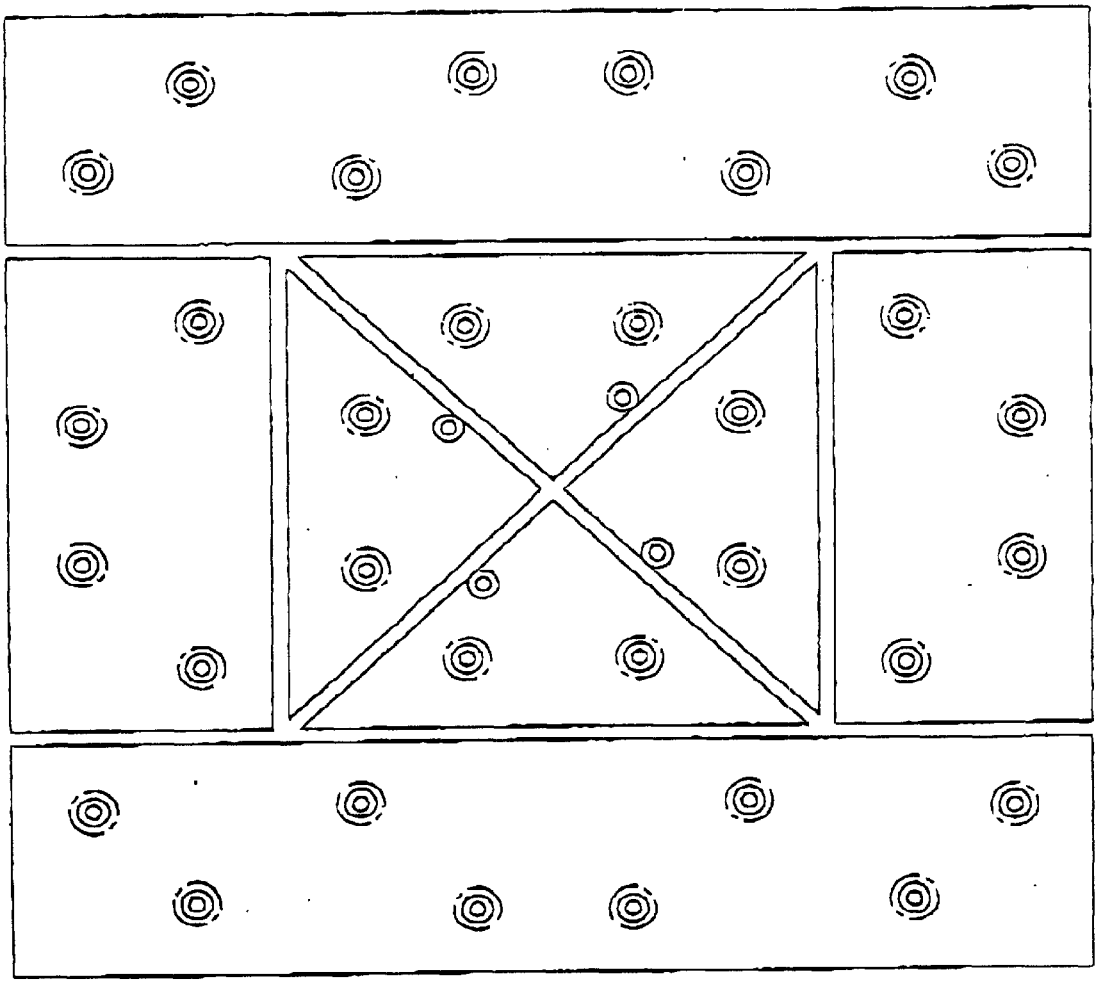
FIG. 13 shows slats in a sixth configuration for attaching to a decking tile, with the apertures for fasteners shown thereon.

FIG. 9 shows an arrangement of the wooden slats, with the middle two slats being cut so as to form a diamond (from two triangles) in the middle of the tile. Because the cuts of the middle two slats fall over the apertures 28 in the inner most four tiles, the further cylinders 62 provide a mechanism for securing the inner most triangles of the wooden slats to the tile. It is specifically for this pattern that the further cylinders 62 are provided on the decking tile 60. If it was not desired to produce this pattern, the further cylinders 62 would not be necessary.

FIGS. 10 to 18 show further patterns of wooden slats that can be accommodated on the decking tiles of the second embodiment. Most of these patterns can also be accommodated on the decking tile of the first embodiment.

Figure 14:
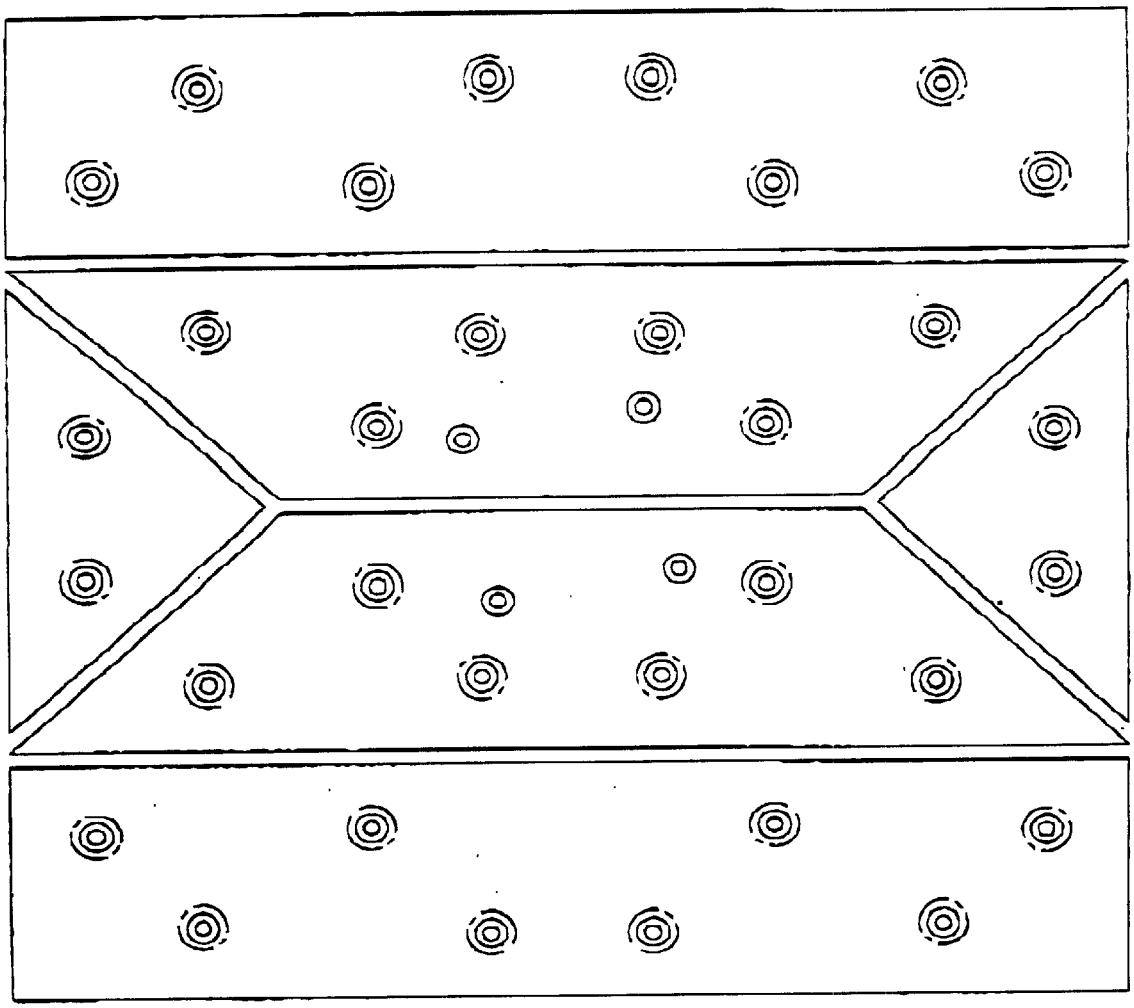
FIG. 14 shows slats in a seventh configuration for attaching to a decking tile, with the apertures for fasteners shown thereon.
Figure 15:
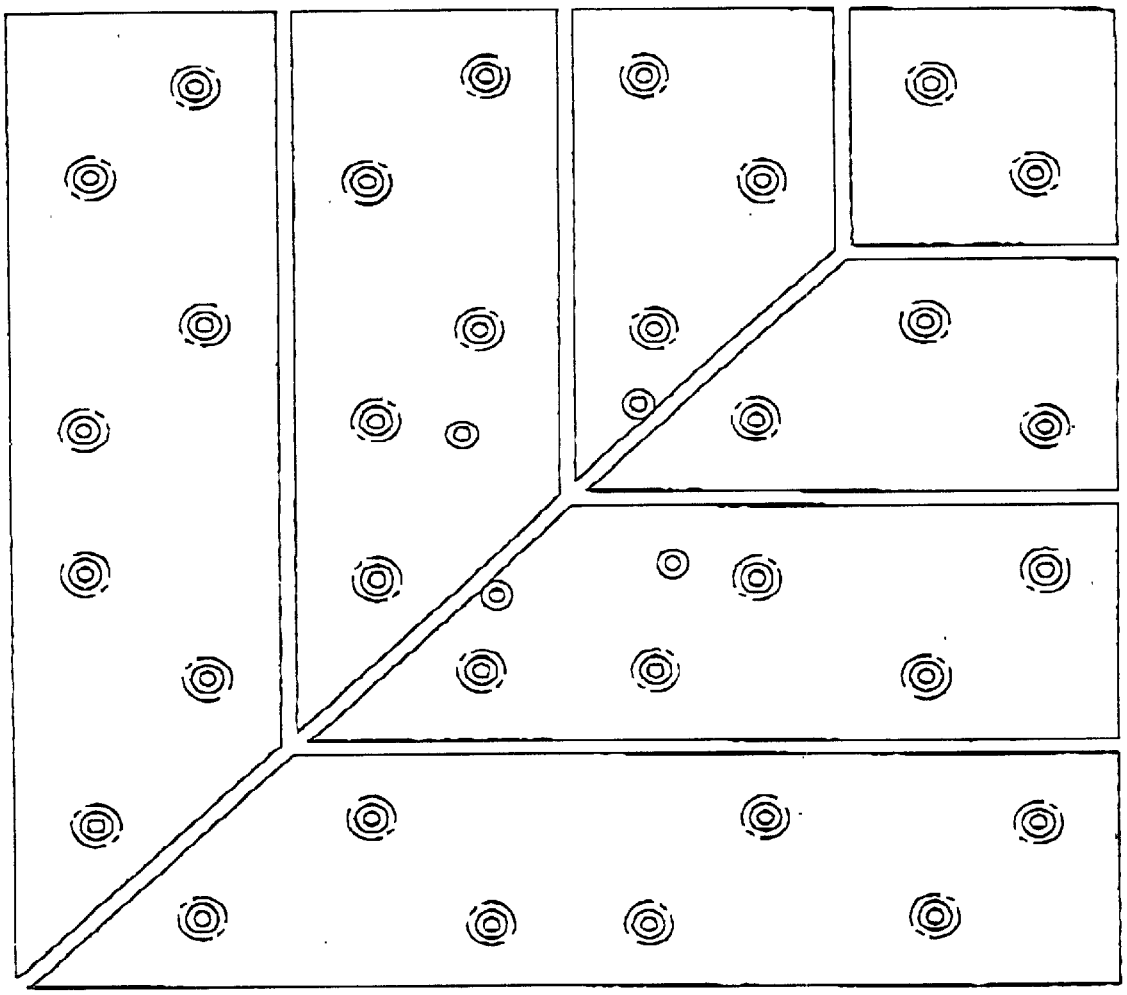
FIG. 15 shows slats in a eighth configuration for attaching to a decking tile, with the apertures for fasteners shown thereon.
Figure 16:
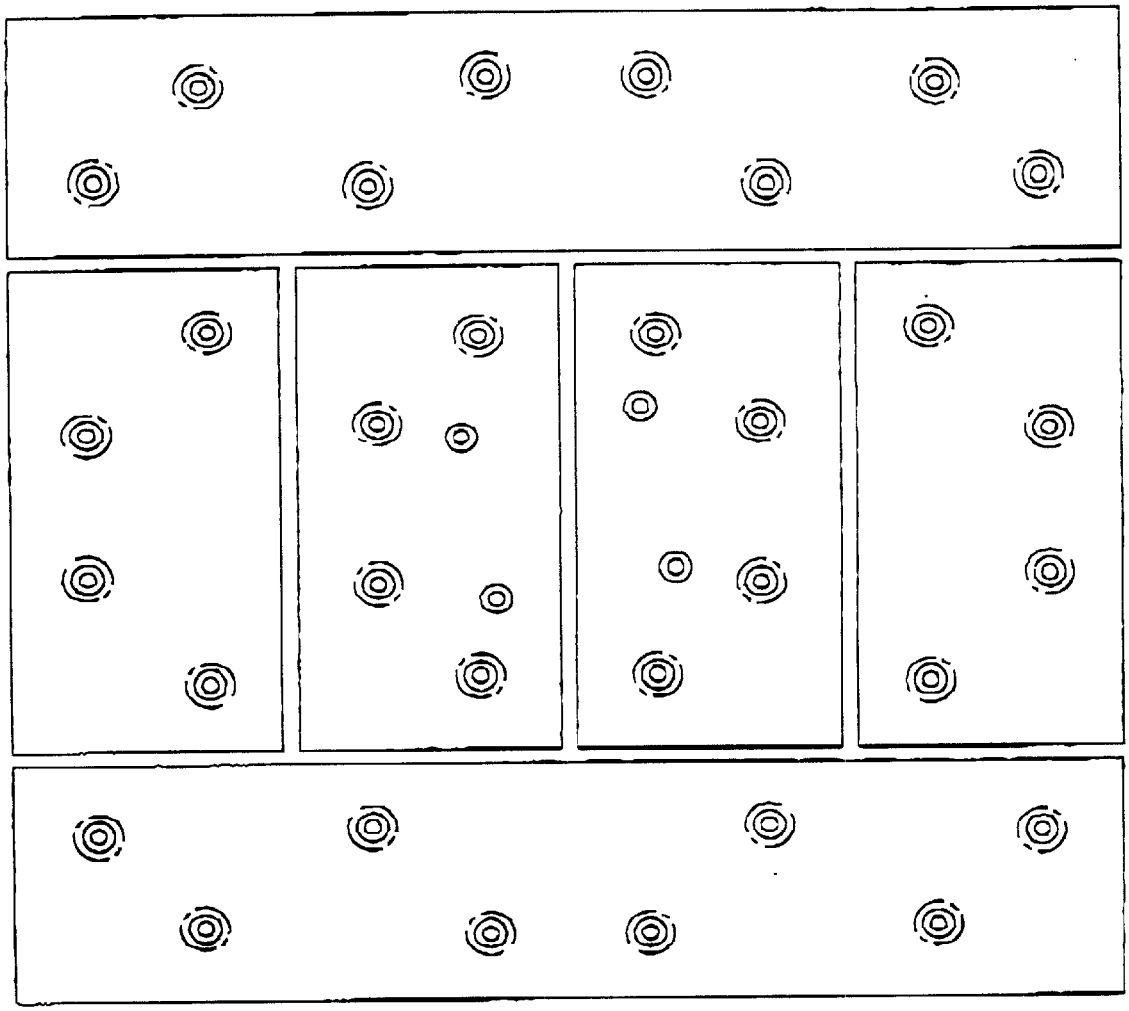
FIG. 16 shows slats in a ninth configuration for attaching to a decking tile, with the apertures for fastener shown thereon.
Figure 17:
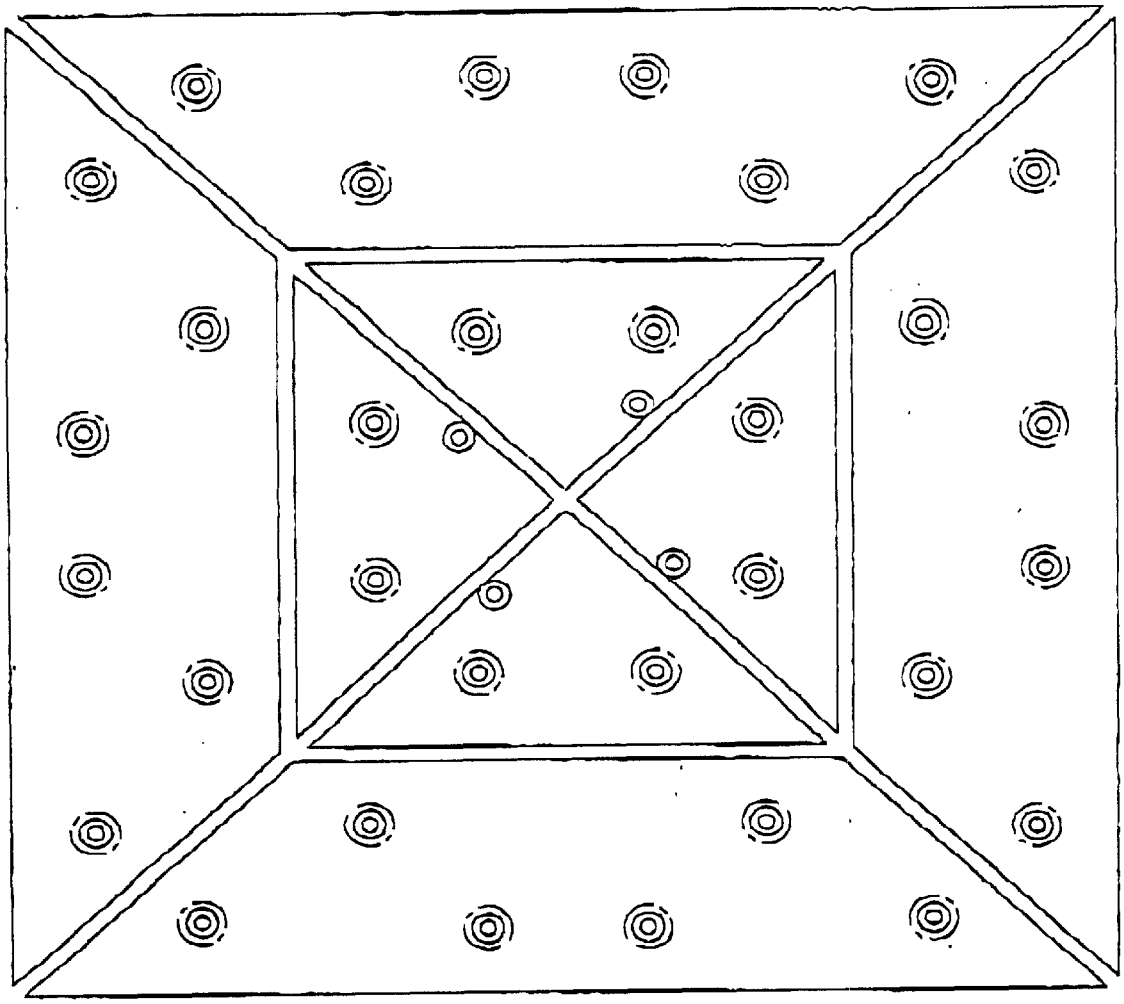
FIG. 17 shows slats in a tenth configuration for attaching to a decking tile, with the apertures for fasteners shown thereon.
Figure 18:
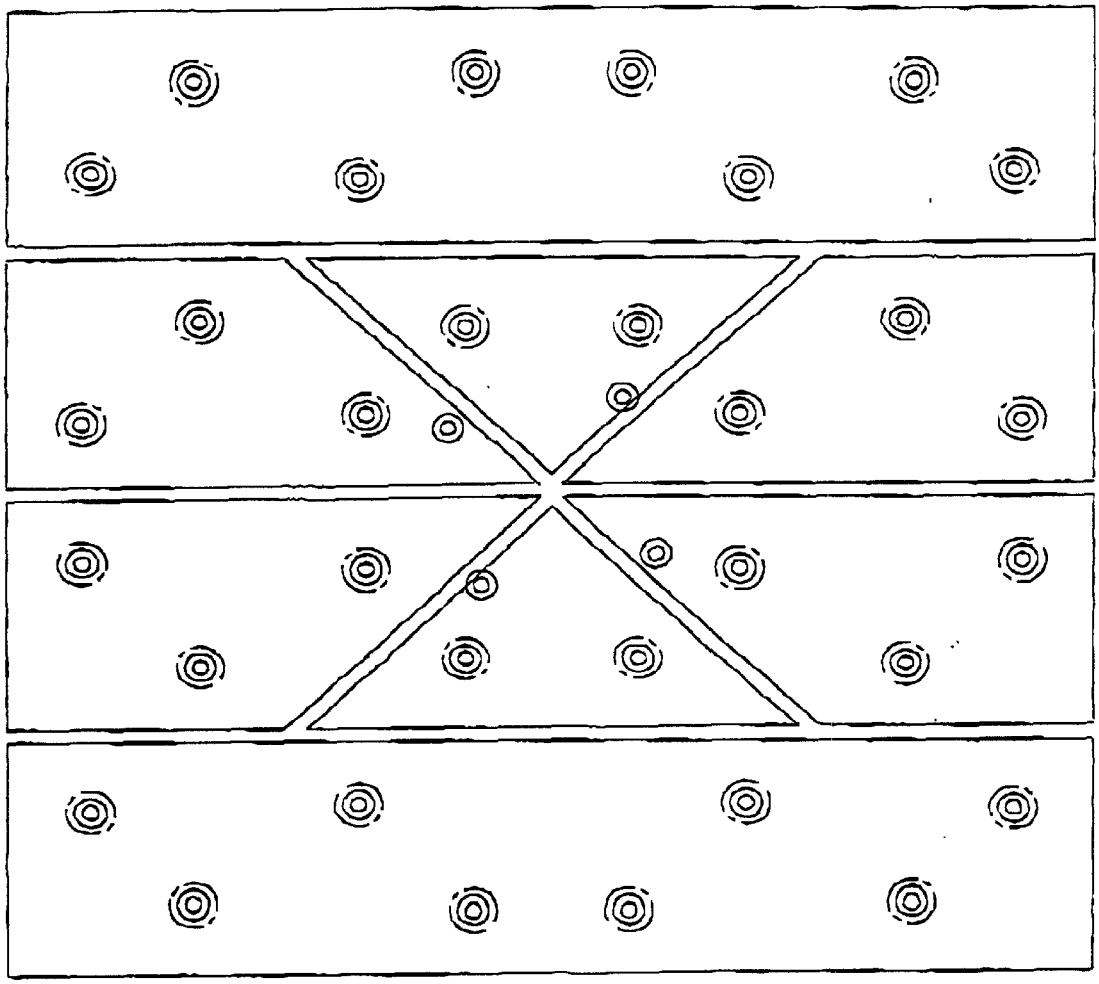
FIG. 18 shows slats in a eleventh configuration for attaching to a decking tile, with the apertures for fasteners shown thereon.

FIG. 14 shows a further arrangement of the wooden slats, with the middle two wooden slats being replaced with two trapezoid-shaped slats and with triangle-shaped slats at each end. Whilst the further cylinders 62 are not required to retain the slats in this pattern, it is to be noted that this pattern requires the apertures 28 to be provided in the configuration shown in relation to the decking tile 60, since the apertures 28 on the decking tile 10 would fall in the gap between the triangle shaped slats and the trapezoid-shaped slats. It is for this reason that the arrangement of the apertures 28 and feet 20 shown in relation to the decking tile 60 is the preferred arrangement.

Accordingly. it can be seen that the invention provides a decking tile which alleviates one of the problems with existing decking tiles. in that portions of the decking tile can be removed and the slats can still be retained without rotation. In addition, the invention provides a decking tile which is capable of having slats form various patterns, greatly enhancing the aesthetic appearance of the decking tiles. Such patterns are not possible with existing decking tiles.

It should be appreciated that the scope of this invention is not limited to the particular embodiments described above.

What is claimed is:

1. A decking tile divided into a plurality of portions arranged in an array, said portions being connected to adjacent portions via a plurality of membranes adapted to be severed, each portion being adapted for removing from said decking tile upon severing of the membranes surrounding it, each portion arranged to receive at least two fasteners to secure a slat thereto, wherein said at least two fasteners can engage a slat positioned parallel to any side of said decking tile, wherein each portion includes at least two apertures, each aperture arranged to receive a fastener therethrough, and wherein each aperture includes a widened section adjacent one end thereof.

2. A decking tile divided into a plurality of portions arranged in an array, said portions being connected to adjacent portions via a plurality of membranes adapted to be severed, each portion being adapted for removing from said decking tile upon severing of the membranes surrounding it, each portion arranged to receive at least two fasteners to secure a slat thereto, wherein said at least two fasteners can engage a slat positioned parallel to any side of said decking tile, wherein each portion includes at least two apertures, each aperture arranged to receive a fastener therethrough, and wherein said aperture is formed in a foot of said tile.

3. A floor covering comprising:

plurality of decking tiles connected together, each decking tile being divided into a plurality of portions arranged in an array, said portions being connected to adjacent portions via a plurality of membranes adapted to be severed, each portion being adapted for removing from said decking tile upon severing of the membranes surrounding it, each portion arranged to receive at least two fasteners to secure a slat thereto, wherein said at least two fasteners can engage a slat positioned parallel to any side of said decking tile; and a plurality of slats provided on the decking tiles.

4. A floor coveting as claimed in claim 3, wherein each decking tile with a side forming a part of the periphery of the floor covering has a skirt provided on each said side, the skirt extending to the floor.

5. A floor covering as claimed in claim 4, wherein said sides of the decking tiles have the connecting means removed therefrom.

6. A decking tile arrangement comprising:

at least one decking tile adapted for connection with one or more other of said at least one decking tiles, said at least one decking tile being divided into a plurality of portions arranged in an array, said portions being connected to adjacent portions via a plurality of membranes adapted to be severed, each portion being adapted for removing from said at least one decking tile upon severing of the membranes surrounding it, each portion arranged to receive at least two fasteners to secure a slat thereto, wherein said at least two fasteners can engage a slat positioned parallel to any side of said at least one decking tile; and a plurality of slats for mounting on said at least one decking tile.

7. A decking tile arrangement as claimed in claim 6, wherein each said at least one decking tile with at least one side forming a part of the periphery of a floor covering has a skirt provided on each at least one side, the skirt extending to the floor.

8. A decking tile arrangement as claimed in claim 7, wherein said side of said at least one decking tile has at least some of the connecting means removed therefrom.

* * * * *